US007161146B2

(12) United States Patent
Doroshenko et al.

(10) Patent No.: US 7,161,146 B2
(45) Date of Patent: Jan. 9, 2007

(54) METHOD AND APPARATUS FOR PRODUCING AN ION BEAM FROM AN ION GUIDE

(75) Inventors: Vladimir M. Doroshenko, Ellicott City, MD (US); Vadym D. Berkout, Rockville, MD (US)

(73) Assignee: Science & Engineering Services, Inc., Columbia, MD (US)

( * ) Notice: Subject to any disclaimer, the term of this patent is extended or adjusted under 35 U.S.C. 154(b) by 181 days.

(21) Appl. No.: 11/039,842

(22) Filed: Jan. 24, 2005

(65) Prior Publication Data

US 2006/0163470 A1 Jul. 27, 2006

(51) Int. Cl.
*H01J 49/40* (2006.01)

(52) U.S. Cl. ..... 250/290; 250/292

(58) Field of Classification Search ..... 250/290, 250/292

See application file for complete search history.

(56) References Cited

U.S. PATENT DOCUMENTS

| | | | | |
|---|---|---|---|---|
| 3,334,225 | A | 8/1967 | Langmuir | |
| 5,689,111 | A | 11/1997 | Dresch et al. | |
| 5,847,386 | A | 12/1998 | Thomson et al. | |
| 5,965,884 | A | 10/1999 | Laiko et al. | |
| 6,107,628 | A | 8/2000 | Smith et al. | |
| 6,630,662 | B1 * | 10/2003 | Loboda | 250/281 |
| 6,727,495 | B1 * | 4/2004 | Li | 250/286 |
| 6,730,904 | B1 * | 5/2004 | Wells | 250/292 |

OTHER PUBLICATIONS

Masamichi Yamashita et al., Electrospray Ion Source, Another Variation on the Free-Jet Theme, 1984, J. Phys. Chem., vol. 88, pp. 4451-4459.

John B. Fenn, et al., Electrospray Ionization for Mass Spectrometry of Large Biomolecules, Oct. 6, Science, 1989, vol. 246, pp. 64-71.

Michael Karas et al., Laser Desorption Ionization of Proteins with Molecular Masses Exceeding 10 000 Daltons, Anal. Chem., 1988, vol. 60, pp. 2299-2301.

Howard R. Morris, et al., High Sensitivity Collsionally-activated Decomposition Tandem Mass Spectrometry on a Novel Quadrupole/Orthogonal-acceleration Time-of-flight Mass Spectrometer, Rapid Commun. In Mass Spectrometry, 1996, vol. 10, pp. 889-896.

(Continued)

*Primary Examiner*—David A. Vanore
(74) *Attorney, Agent, or Firm*—Oblon, Spivak, McClelland, Maier & Neustadt, P.C.

(57) ABSTRACT

A method and system for producing an ion beam from an ion guide. In the method, ions are introduced into the ion guide, a radio frequency trapping field is generated in the ion guide to confine ions in a direction transverse to a longitudinal axis of the ion guide, a DC potential is generated along the longitudinal axis to direct ion motion along the longitudinal axis, a strength of the radio frequency trapping field is reduced toward an ion guide exit of the ion guide, and the ions are transmitted from the ion guide exit to form the ion beam. In the system, an ion guide is configured to transmit ions in a longitudinal axis of the ion guide and configured to trap ions in a direction transverse to the longitudinal axis via a radio frequency trapping field. The ion guide includes a segmented set of electrodes spaced along the longitudinal axis and an ion guide exit at the last of the segmented set of electrodes. A radio frequency device is configured to supply the radio frequency trapping field such that a strength of the radio frequency trapping field is reduced toward the ion guide exit.

49 Claims, 8 Drawing Sheets

OTHER PUBLICATIONS

Andrej Shevchenko et al., Rapid 'de Novo' Peptide Sequencing by a Combination of Nanoelectrospray, Isotopic Labelling and a Quadrupole/Time-of-Flight Mass Spectrometer, Rapid Commun. In Mass Spectrometry, 1997, vol. 11, pp. 1015-1024.

Olga A. Mirgorodskaya et al., Electrospray Ionization Time-of-Flight Mass Spectrometry in Protein Chemistry, 1994, Anal. Chem., vol. 66, pp. 99-107

Anatoll N. Verentchikov et al, Reflecting Time-of-Flight Mass Spectrometer with an Electrospray Ion Source and Orthogonal Extraction, Anal. Chem., 1994, vol. 66, pp. 126-133.

Hermann Wollnik, Ion Optics in Mass Spectrometers, Journal of Mass Spectrometry, 1999, vol. 34, pp. 991-1006.

Vladimir M. Doroshenko et al., A Quadrupole Ion Trap/Time-of-Flight Mass Spectrometer with a Parabolic Reflectron, Journal of Mass Spectrometry, 1998, vol. 33, pp. 305-318.

Michael V. Gorshkov et al., Dynamically assisted gated trapping for Fourier Transform Ion Cyclotron Mass Spectrometry, Rapid Communications In Mass Spectrometry, Rapid Commun., Mass Spectrom., 2001, vol. 15, pp. 1558-1561.

* cited by examiner

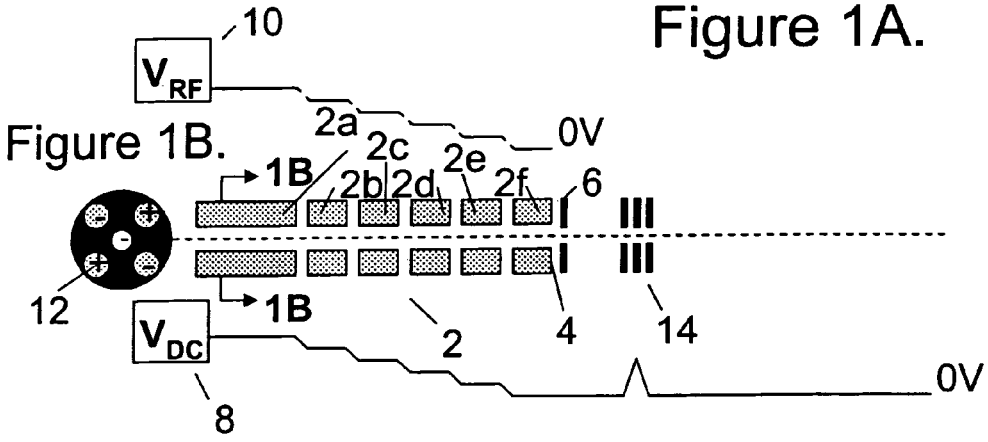
Figure 1A.
Figure 1B.
10
$V_{RF}$
2a
2c
2e
0V
1B
2b
2d
2f
6
12
1B
$V_{DC}$
2
4
14
0V
8
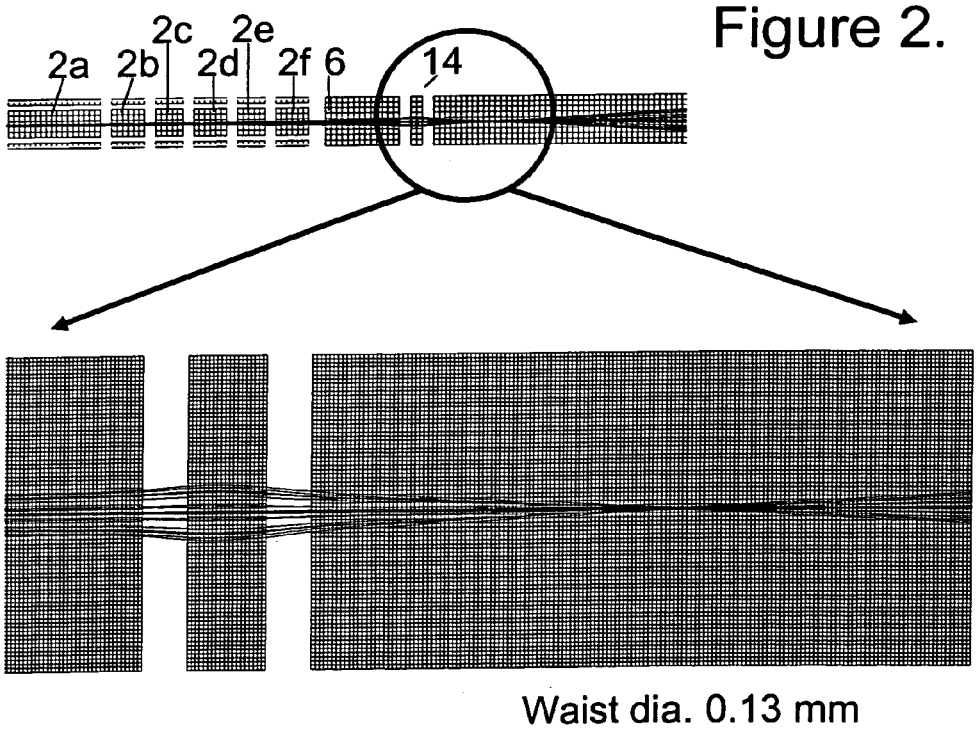
Figure 2.
2a
2b
2c
2d
2e
2f
6
14
Waist dia. 0.13 mm

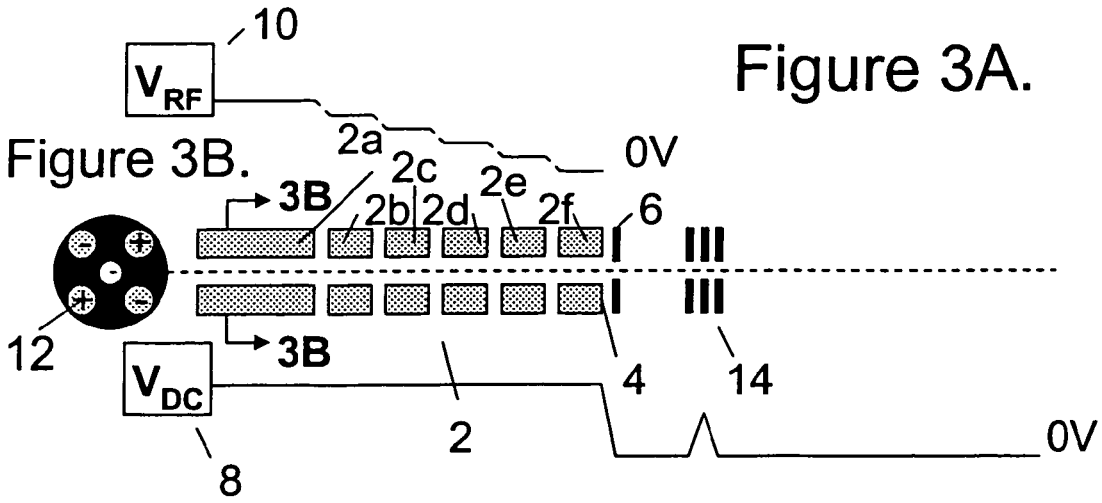
10
$V_{RF}$
Figure 3A.
Figure 3B.
2a
2c
2e
0V
3B
2b
2d
2f
6
12
3B
4
14
$V_{DC}$
2
0V
8
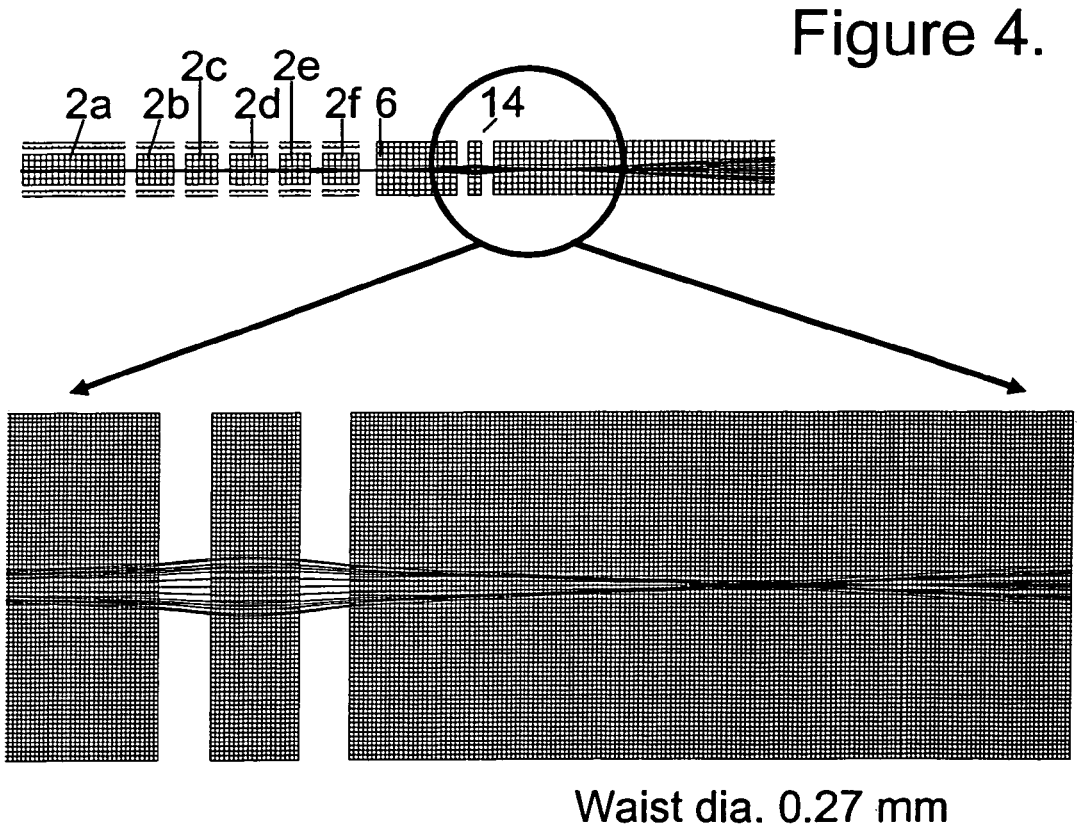
Figure 4.
2c
2e
2a
2b
2d
2f
6
14
Waist dia. 0.27 mm Figure 5A.
(Background art)
Figure 5B.
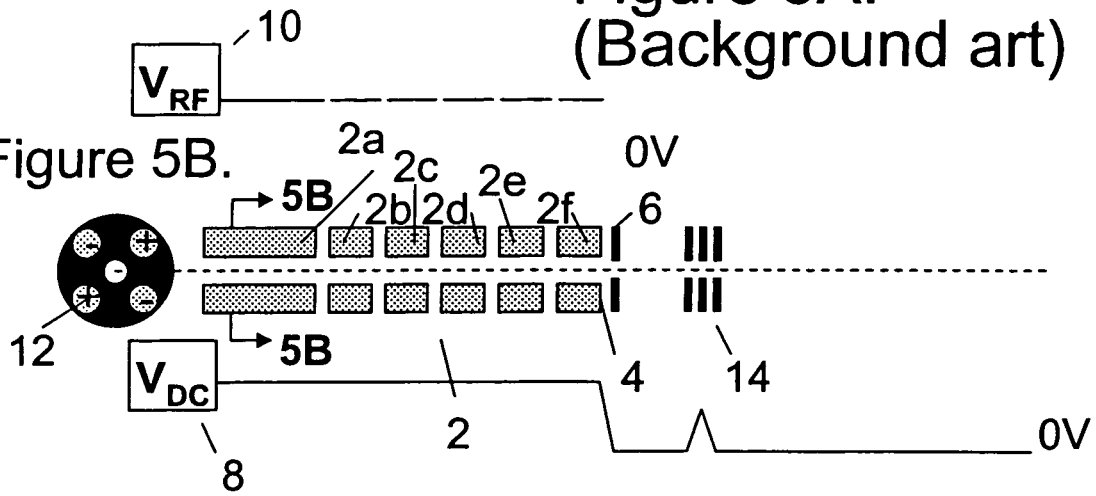
Figure 6.
(Background art)
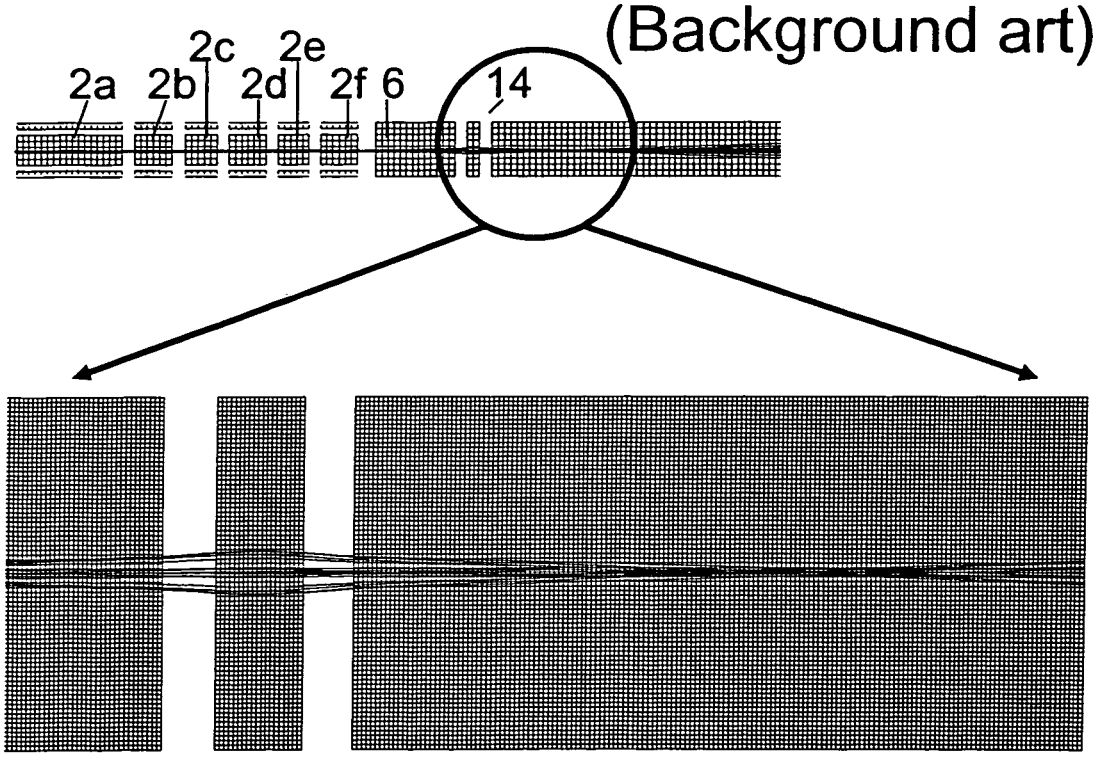
Waist dia. 0.39 mm Waist dia. 0.44 mm

METHOD AND APPARATUS FOR PRODUCING AN ION BEAM FROM AN ION GUIDE

CROSS-REFERENCE TO RELATED APPLICATIONS

This application is related to U.S. Serial application Ser. No. 10/441,004 entitled "Method of Ion Fragmentation in a Multipole Ion Guide of a Tandem Mass Spectrometer," filed on May 20, 2003, the entire contents of which is incorporated herein by reference.

BACKGROUND OF THE INVENTION

1. Field of the Invention

This invention relates in general to mass spectrometry (MS) especially to mass spectrometry utilizing multipole ion guides, and in particular to orthogonal acceleration (oa) time-of-flight (TOF) MS. More specifically, this invention relates to a configuration and a method of using multipole ion guide to transport and focus ions into a mass analyzer.

2. Description of the Related Art

Over the last decade, mass spectrometry has played an increasingly important role in the identification and characterization of various biochemical compounds in research laboratories and various industries. The speed, specificity, and sensitivity of mass spectrometry make spectrometers especially attractive for requiring rapid identification and characterization of biochemical compounds. Mass spectrometric configurations are distinguished by the methods and techniques utilized for ionization and separation of the analyte molecules. The mass separation process can include techniques for ion isolation, subsequent molecular fragmentation, and mass analysis of the fragment ions. The pattern of fragmentation yields information about the structure of the analyte molecules introduced into the mass spectrometer. The technique of combining ion isolation, molecular fragmentation, and mass analysis is referred to in the art as tandem (or MS/MS) mass spectrometry.

Atmospheric pressure ion sources have become increasingly important as a tool for generating ions used in mass analysis. Electrospray ionization (ESI), Atmospheric Pressure Chemical Ionization (APCI), and Inductively Couple Plasma (ICP) ion sources produce ions from analyte species at atmospheric pressure. Once produced, ions can be transported into a vacuum of mass spectrometer using an atmospheric pressure interface. In addition to ESI (see Yamashita, M.; Fenn, J. B. *J. Chem. Phys.* 1984, 88: 4451 and Fenn, J. B.; Mann, M.; Meng, C. K.; Wong, S. F.; Whitehouse, C. M. *Science* 1989, 246: 64, the entire contents of which are incorporated herein by reference), another known technique for producing gas phase ions of large biomolecules is matrix-assisted laser desorption/ionization (MALDI—see Karas, M; Hillenkamp, F.; *Anal. Chem.* 1988, 60, 2299–2301, the entire contents of which are incorporated herein by reference). ESI and MALDI are characterizable as soft ionization techniques of large biomolecules. ESI produces multiply-charged molecular ions while MALDI produces mostly singly-charged ions. ESI continuously produces ions at normal atmospheric conditions while MALDI is a pulsed ionization method. Liquid separation techniques such as, for example, high pressure liquid chromatography (HPLC), chemical electrospray (CE), and recently developed electrochromatography coupled on-line with ESI mass spectrometry have made major contributions to the success of modern biochemistry, pharmacology and health sciences.

Until recently, MALDI was mostly used for producing ions under vacuum conditions. An atmospheric pressure matrix-assisted laser desorption/ionization (AP-MALDI) source (Laiko et al. U.S. Pat. No. 5,965,884, the entire contents of which are incorporated herein by reference) produces ions of biomolecules under normal atmospheric pressure conditions. AP-MALDI ions are then introduced into a mass spectrometer using an atmospheric pressure interface similar to that used for introduction of ESI ions.

Known techniques for analyzing ion masses include: sector magnetic instruments, quadrupole mass spectrometers, quadrupole ion trap mass spectrometers, time-of-flight (TOF) mass spectrometers, orthogonal acceleration (oa) TOF-MS, Fourier transform ion cyclotron resonance mass spectrometers (FTICR-MS). Radio frequency (RF) ion guides are widely used for delivering ions from the atmosphere side to the vacuum inside mass spectrometers as well as for transporting ions from one point in space to another point of space within the vacuum of a mass spectrometer. A trapping field in the transverse direction of an ion guide can be created by applying an alternating RF voltages to the ion guide electrodes. Ion guides can include single or multiple sections of parallel rods to which the alternative RF voltages can be applied. Ion guides are typically designated according to the number of the rods used in the section: quadrupoles, hexapoles, octopoles, or multipoles if four, six, eight, or more rods are used. In the ion guides, RF voltages are applied to neighboring rods in each section with a shifted phase (normally shifted by 180°).

Another way of making ion guide sections is to place a series of circular electrodes, each with a hole in the center, in a stack. When the RF voltage (shifted by 180° for adjacent electrodes) is applied, the ions are confined near the central axis of the stack. A wall with an aperture (referred to as a conductance limit) can separate the sections so that a different pressure can be maintained within any section.

Collisions with buffer gas molecules in ion guides sections can facilitate damping ion excessive energy so that the temperature of ions after several collisions may be close to the room temperature (295 K). A typical pressure of the buffer gas in the ion guide is the range of 0.1–100 mTorr, but can be lower or substantially higher as in an ion funnel. (See for example Smith et al, U.S. Pat. No. 6,107,628, the entire contents of which are incorporated herein by reference, which represents one more ion guide design).

In addition to operation as an ion guide, a quadrupole can operate in a mass filter mode. See, for example, Langmuir U.S. Pat. No. 3,334,225, the entire contents of which are incorporated herein by reference. In a mass filter mode, one of the ion guide quadrupole sections is normally tuned to pass ions within a selected m/z range that is required for operation in the above-noted tandem MS mode.

The ion energy within an ion guide section can be controlled by adjusting a DC voltage along the ion guide axis and/or by adjusting the trapping voltage on separate sections. By adjusting the DC voltage along the ion guide center (which can be done by floating sections at different DC voltages or using other mechanisms as described in Thomson et al. U.S. Pat. No. 5,847,386, the entire contents of which are incorporated herein by reference) one can drift ions through the buffer gas, thus heating internal degrees of freedom of the ions and even causing the ion dissociation. Fragmenting ions in the ion guides by collisional dissociation is widely used in tandem mass spectrometry.

In addition to a transmission mode in which ions are transported from one place to another, the ion guide can also work in an ion trap mode. See Dresh et al., U.S. Pat. No.

5,689,111, the entire contents of which are incorporated herein by reference. In an ion trap mode, the DC potentials on the conductance limits or on the adjacent ion guide sections are raised (for positive ions) to confine ions within the selected section. The trapped ions can then be manipulated within such a trap. Such manipulation of the ions can result in ion isolation, fragmentation and analysis. These operational modes are widely used in commercial instruments, such as for example, in Thermo Finnigan (Santa Clara, Calif.) LTQ™ mass spectrometer.

One triple quadrupole mass spectrometer (MS) can be a tandem mass spectrometer interfaced with an electrospray ion source. A triple quadrupole mass spectrometer includes three (normally quadrupole) sections that are used for ion isolation, fragmentation, and mass analysis. Triple quadrupole MS offers medium resolution (up to several thousands) and low mass range (up to 2000–3000 Da) for MS/MS analysis more sections can be added for auxiliary purposes. To overcome these limitations, hybrid quadrupole time of flight (Q-TOF or QqTOF where Q and q denote quadrupole sections operating as an ion filter and ion guide, respectively) instruments were developed. These techniques have been described for example by Morris et al., in Rapid Commun. Mass Spectrometry, 1996, 10:889–896, and by Shevchenko et al., Rapid Commun. Mass Spectrom. 1997, 11:1015–1024, the entire contents of which are incorporated herein by reference. The QqTOF configuration can be considered as a replacement of the third quadrupole in a triple quadrupole instrument by an orthogonal acceleration (oa)-TOF mass analyzer. Compared to a quadrupole analyzer, an orthogonal acceleration TOF mass spectrometer is a high resolution and high mass accuracy instrument (see for example, Mirgorodskaya, O. A.; Shevchenko, A. A.; Chernushevich, I. V.; Dodonov, A. F.; Miroshnikov, A. I., *Anal. Chem.* 66 (1994) 99; and Verentchikov, A. N.; Ens, W.; Standing, K. G., *Anal. Chem.* 66 (1994) 126, the entire contents of which are incorporated herein by reference). Because of the high mass accuracy provided by an oa-TOF instrument, it is valuable even in the normal MS mode, without the necessity of ion isolation and fragmentation sections in an ion guide (like in a commercial AccuTOF ESI-oa-TOF instrument from JEOL USA, Peabody, Mass.). The benefits of the QqTOF system are high sensitivity, mass resolution, and mass accuracy in both precursor (MS) and product ion (MS/MS) modes. A particular advantage for full-scan sensitivity (over a wide mass range) is provided in both modes by the parallel detection feature available in time-of-flight mass analyzer.

A high resolution in oa-TOF instruments is achieved using the orthogonal extraction of ions from the ion beam with a small spatial and velocity spread in the "time of flight" direction. The beam is usually formed from ions released from the ion guide by accelerating the ions to an energy of about 20 eV, and focusing and shaping the ion beam to make the beam divergence properties close to a parallel beam. This translates to a very high mass resolution (up to 20,000) and mass accuracy (down to few ppm) obtained in this kind of instruments. However, the high quality of the beam is usually achieved at the expense of instrument sensitivity since many ions are cut off of the beam to make a narrow ion distribution in the phase (i.e., the coordinate and velocity) space. For this reason, designing oa-TOF and QqTOF instruments always implies a trade-off between the sensitivity and mass resolution. Achieving both high sensitivity and high mass resolution/accuracy is one of practical and theoretical considerations.

Generating high quality ion beams (i.e., beams having a narrow spatial and velocity spreads) is also important in other MS instruments (see H. Wollnik, J. Mass Spectrom, 1999, 34: 991–1006, the entire contents of which are incorporated herein by reference). As an example, the capture of injected ions into a quadrupole ion trap can be substantially increased if ions are narrowly packed in the afore-mentioned phase space (see, for example, Doroshenko, V. M.; Cotter, R. J., *J Mass Spectrom.* 33 (1998) 305, the entire contents of which are incorporated herein by reference). Similar trapping problem exists in Fourier transform ion cyclotron resonance (FTICR) traps (M. V. Gorshkov, C. D. Masselon, G. A. Anderson, H. R. Udseth, R. D. Smith, Rapid Comm. Mass Spectrom., 2001, 15: 1558–1561, the entire contents of which are incorporated herein by reference).

SUMMARY OF THE INVENTION

One object of the present invention is to decrease ion beam divergence at an exit of a multipole ion guide.

A further object of the present invention is to increase the density of the ion beam originating from an ion guide.

Yet another object of the present invention is to increase the mass resolution in an oa-TOF mass spectrometer while maintaining the same instrument sensitivity.

Still another object of the present invention is to increase the sensitivity of the oa-TOF mass spectrometer while maintaining a suitable mass resolution.

Various of these and other objects are provided, according to the present invention, in a method and a system for producing an ion beam. In the method, ions are introduced into the ion guide, a radio frequency trapping field is generated in the ion guide to confine ions in a direction transverse to a longitudinal axis of the ion guide, a DC potential is generated along the longitudinal axis to direct ion motion along the longitudinal axis, a strength of the radio frequency trapping field is reduced toward an ion guide exit of the ion guide, and the ions are transmitted from the ion guide exit to form the ion beam.

In the system, an ion guide is configured to transmit ions in a longitudinal axis of the ion guide and configured to trap ions in a direction transverse to the longitudinal axis via a radio frequency trapping field. The ion guide includes a segmented set of electrodes spaced along the longitudinal axis and an ion guide exit at the last of the segmented set of electrodes. A radio frequency device is configured to supply the radio frequency trapping field such that a strength of the radio frequency trapping field is reduced toward the ion guide exit.

In another aspect of the present invention, the divergence of the ion beam originating from the ion guide of the present invention is smaller than in conventional ion beam formation systems, thus resulting in a denser ion beam after shaping the original ion beam into the "parallel" beam to be introduced into the acceleration region of an oa-TOF-MS. This results in a higher instrument sensitivity at the same mass resolution or, if the ion beam is shaped into a more narrow beam results in a higher mass resolution while maintaining the same sensitivity.

It is to be understood that both the foregoing general description of the invention and the following detailed description are exemplary, but are not restrictive of the invention.

BRIEF DESCRIPTION OF THE DRAWINGS

A more complete appreciation of the present invention and many attendant advantages thereof will be readily obtained as the same becomes better understood by reference to the following detailed description when considered in connection with the accompanying drawings, wherein:

FIG. 1A is an ion guide schematic according to one embodiment of the present invention;

FIG. 1B is an end view of the ion guide depicted in FIG. 1A;

FIG. 2 and its inset are schematic representations of numerical simulation results for the embodiment of the present invention shown in FIGS. 1A–B;

FIG. 3A is an ion guide schematic for another embodiment of the present invention;

FIG. 3B is an end view of the ion guide depicted in FIG. 3A;

FIG. 4 and its inset are schematic representations of numerical simulation results for the embodiment of the present invention shown in FIGS. 3A–B;

FIG. 5A is an ion guide schematic representing a background art configuration;

FIG. 5B is an end view of the ion guide depicted in FIG. 5A;

FIG. 6 and its inset are schematic representations of numerical simulation results for the background art shown in FIGS. 5A–B;

FIG. 7B is an end view of the ion guide depicted in FIG. 7A;

DETAILED DESCRIPTION OF THE PREFERRED EMBODIMENTS

Figure 7A:
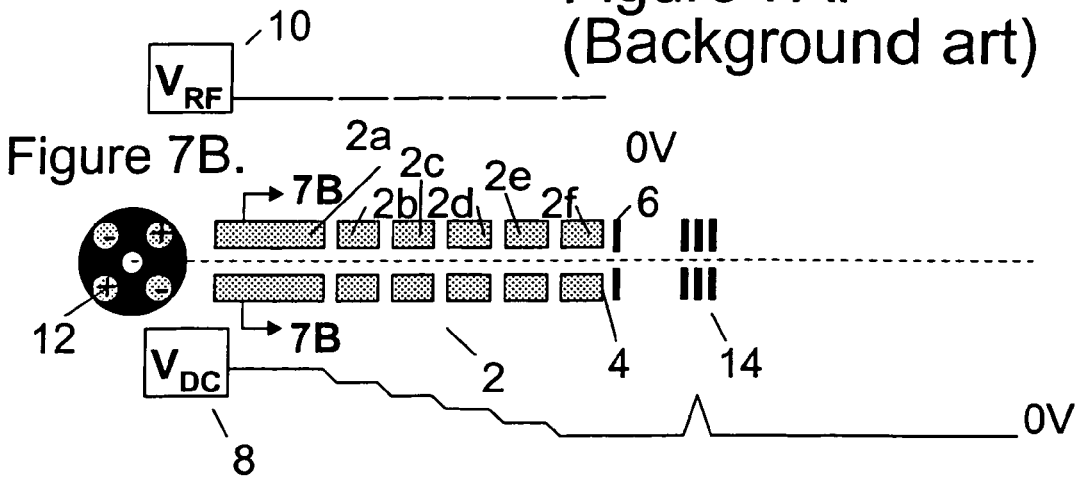
Figure 7A. (Background art)
FIG. 7A is an ion guide schematic representing another background art configuration.

Referring now to the drawings, wherein like reference numerals designate identical, or corresponding parts throughout the several views, and more particularly to FIG. 1A, FIG. 1A is a schematic according to one embodiment of the present invention for generating an ion beam from an ion guide 2. As such, the system illustrated in FIG. 1A includes an ion guide 2 configured to transmit ions along a longitudinal axis of the ion guide 2 and configured to trap ions in a direction transverse to the longitudinal axis via a radio frequency trapping field. The ion guide includes a segmented set of electrodes 2*a*, 2*b*, 2*c*, 2*d*, 2*e*, and 2*f* spaced along the longitudinal axis and an ion guide 4 exit at the last of the segmented set of electrodes. A radio frequency device 10, as shown in FIG. 1A, is configured to supply the radio frequency trapping field such that a strength of the radio frequency trapping field is progressively reduced toward the ion guide exit. For example, towards the exit 4 of the quadrupole ion guide 2, the quadrupole ion guide 2 can be separated into smaller quadrupole sections 2*b*, 2*c*, 2*d*, 2*e*, and 2*f* than the quadrupole section 2*a*, as illustrated in FIG. 1A.

The lengths of quadrupole sections 2*b*, 2*c*, 2*d*, 2*e*, and 2*f* should be in general close to the value of an inscribed diameter of these quadrupoles to provide the smoothness of DC and RF fields along the ion guide 2. The total number of sections determines the total length of the ion guide section where RF field is decreasing. In general this total length is preferably larger than the inscribed diameter of quadrupoles. The stepwise distribution of DC and RF fields (usually achievable when the lengths of sections 2*b*, 2*c*, 2*d*, 2*e*, and 2*f* are larger than the inscribed diameter of the quadrupoles) along the ion guide is also possible as long as the total length of these sections is less than the ion mean free path between collisions with buffer gas molecules.

Each section 2*b*, 2*c*, 2*d*, 2*e*, and 2*f* can be made of for example from four 10-mm long metal rods with a radius of about 4 mm equally placed at the distance $r_0$ of about 3.48 mm from the central axis. The sections 2*b*, 2*c*, 2*d*, 2*e*, and 2*f* are preferably, but not necessarily, placed collinearly 2 mm apart from each other. There can be an exit lens 6 preferably, but not necessarily, at a distance of about 4 mm from the end quadrupole section 2*f*. The exit lens 6 can be made for example to be a 1-mm thick round disc with a 2-mm diameter central through hole 8.

In one aspect of the present invention, a trapping RF voltage having a zero-to-peak amplitude $V_{RF}$ and a frequency $f_{RF}$ is applied to respective of the quadrupole rods 12 forming the quadrupole ion guide 2 (in counter phase for adjacent rods as shown in FIG. 1B). The trapping voltage can be different on different ion guide sections (or can be the same on some or all of the sections). In addition, a DC power supply 8 can provide a floating voltage $V_{DC}$ to the rods 12, preferably but not necessarily the same floating voltage to all the rods within a section but with different floating voltages for different ion guide sections. The DC voltages together with the DC voltage $V_{exit}$ applied to the exit lens 6 determine the ion acceleration along the ion guide axis while the trapping RF voltage creates the effective trapping potential in the radial direction which in a pseudo-potential approximation can be determined as $$U_{trap}=q_r V_{RF}/8 \tag{1}$$

where $$q_r=4V_{RF}ze/m\Omega^2 r_0^2 \tag{2}$$

is a dimensionless Mathieu parameter describing the stability of ion's radial motion within the quadrupole ion guide; m and z are correspondingly the ion mass and electric charge in units of elementary charge e; $\Omega=2\pi f_{RF}$ is a circular frequency of the trapping voltage.

In the pseudo-potential approximation (which is normally valid at $q_r<0.4$) the ion motion in the radial direction within the ion guide effective diameter $d=2r_0$ can be described as harmonic secular oscillation with a frequency $\omega<<\Omega$ within a parabolic potential well having the depth of $U_{trap}$ with much smaller "ripple" oscillations at the drive frequency $\Omega$. The secular frequency $\omega$ is dependent on the ion mass/charge ratio. Thus, one can selectively excite ions having different masses by applying a small resonant electric field across the axis that is normally used for ion isolation, fragmentation, or ejection from the ion guide. Such selective manipulation of ions can be done in transmission and trapping modes, and can be the basis for using ion guide configuration and method of the present invention in tandem mass spectrometry.

The DC voltages $V_{DC}$ and $V_{exit}$ establish the ion motion along the ion guide axis. The ions can move in a collisionless mode (when the buffer gas pressure is low so that the mean free path is larger that the ion guide characteristic size) or in a collisional mode that is characterized by a sustained average velocity in the axial direction which is proportional to the electric field strength $E_z$ in the axial direction. The former mode is usually observed when the pressure of the buffer gas is less than 1 mTorr. The latter mode is usually observed when the pressure of a buffer gas higher than 1–10 mTorr. In a preferred embodiment, the ions do not experience collisions with buffer gas molecules while the ions are accelerated to exit the ion guide section (typical pressure in the acceleration part of the ion guide is 0.1–1 mTorr or less). After exiting the ion guide, ions preferably fly in collisionless mode (typical pressures $10^{-5}$–$10^{-4}$ Torr or less). Other configurations and modes are possible.

In the embodiment shown in FIGS. 1A–B, the trapping voltage $V_{RF}$ can be decreased in a stepwise reduction toward the quadrupole ion guide exit section 2*f*, decreased linearly with distance, with a considerably reduced (10–100 times) trapping voltage (in comparison to the RF voltage applied to the quadrupole section 2*a*) applied to the exit quadrupole section 2*f*. The DC voltage can also be decreased approximately linearly from for example an initial 20 V to a final 0 V (ground) applied to the exit quadrupole section 2*f* and the exit lens 6. Further, the decrease in DC or RF voltages between sections 2*b*–2*f* of the ion guide can be non-linear. Moreover, the spacings between the sections 2*b*–2*f* need not be linear.

In the collisionless mode (i.e., when the pressure is below or about 1 mTorr), in the exit part of the ion guide, the ions are gradually accelerated in the axial direction toward the exit lens 6 while experiencing less and less force in the radial direction from the RF field. As a result, suitable conditions can be achieved according to the present invention for forming ion beam with a small divergence, by minimizing the effects of both the electric fringe field and the ion's radial "kick-off" by the trapping RF field observed at the ion guide exit.

In a preferred embodiment, ions moving along the ion guide typically fill a central area near the ion guide axis which is determined by the pseudopotential well depth (defined by equation (1)). The average kinetic energy in a radial direction, after thermalization via collisions with buffer gas molecules, usually is close to room temperature (i.e., in a vicinity of 295 K). A typical diameter of the central area filled by ions is in the range 0.5–1 mm, depending on the ion mass, RF voltage applied, and effective quadrupole diameter. When ions leave the ion guide, the ions experience the radial kick-off effect, which is due to the cut-off of "ripple" ion motion (i.e. oscillations at the trapping frequency Ω of applied RF field) at the arbitrary phase. This effect becomes especially significant for the ions moving off the axis. In the preferred embodiment, the present invention effectively reduces and/or minimizes this effect by reducing the strength of RF field at the exit of the ion guide.

The quality of the resulted ion beam has been determined by simulation of the ion motion in the ion guide geometry using an industry standard SIMION software package (see Dahl, D. A. SIMION 3D Version 6.0 User's Manual, Princeton Electronic Systems, Inc., Princeton, N.J., 1995). One such simulation is shown in FIG. 2 simulating the configuration shown in FIGS. 1A–B. The spatial resolution determined by the spatial grid used in this simulation was 0.2 mm. Other simulation parameters were: the trapping voltage on the ion guide first quadrupole section 2*a* was set at 200 $V_{0\text{-}peak}$; the length of this first section was set at 29 mm; seventeen ions were chosen for simulation with an initial energy for the entering ions equal to 0.03 eV (this approximately corresponds to the energy at the room temperature of 295 K and implies that ions were thermalized in collisions with buffer gas molecules before entering the ion guide simulated here); the entering ion's initial velocity vectors were evenly spread in the angle range from 80° to −80° relative to the axis of the ion guide; all ions started motion at axis point at the ion guide entry (at the left end of the first quadrupole 2*a*).

To monitor the divergence of the ion beam, which is defined as an angle deviation α in ion trajectories within a group of ions passing via the same point of the space, an Einzel lens 14 was set at the distance of 18 mm from the exit lens 6 in the simulation. The Einzel lens 14 in the simulation included three cylindrical 4-mm thick electrodes with 4-mm diameter central holes located 2 mm apart of each other. The side electrodes are set at 0 V while the voltage on the central electrode of the Einzel lens is adjusted to 12.1 V to focus the exiting ion beam downstream 21 mm after the Einzel lens center.

The divergence angle of the ion beam in the simulated geometry can be determined by the following formula (in radians):

$$\alpha = d_{waist}/F \tag{3}$$

where $d_{waist}$ is the diameter of the beam waist at the point of beam's maximum focus; and F=21 mm is the focal distance of the ion beam focus. Thus, the waist diameter $d_{waist}$ can be used as a measure of the beam divergence if the focal distance remains the same. As one can see on the inset of FIG. 2, $d_{waist}$ is shown to be 0.13 mm for the embodiment shown in FIG. 1A.

In another embodiment of the present invention as shown in FIGS. 3A–B, the same DC voltage of 20 V is applied to all sections 2*a*, 2*b*, 2*c*, 2*d*, 2*e*, and 2*f* of the ion guide while the RF voltage is decreased the same way as in FIG. 1A (from 200 $V_{0\text{-}peak}$ on the first quadrupole to zero on the exit section 2*f*). The voltage on the central electrode of the Einzel lens was adjusted to 13.4 V to obtain a beam focused approximately at F=21 mm. In the configuration of FIG. 3A, the simulated beam waist diameter $d_{waist}$ is shown to be 0.27 mm (see FIG. 4 and its inset), larger than that achieved for the configuration in FIG. 1A but still better than that in background art (shown below).

Figure 8:
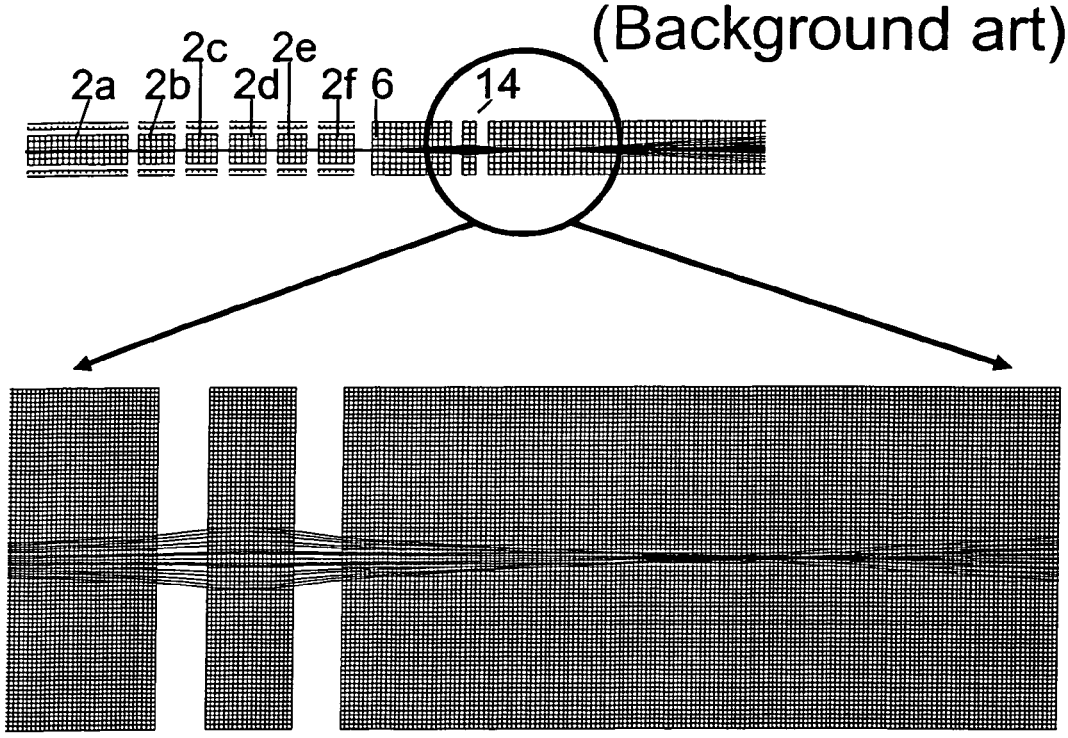
Figure 8. (Background art)
FIG. 8 and its inset are schematic representations of numerical simulation results for the background art shown in FIGS. 7A–B.

For comparison, the simulations were made for two more configurations representing background art configurations. The background art configurations are shown in FIGS. 5A–5B and 7A–7B. The RF voltage is the same (200 $V_{0\text{-}peak}$) for all quadrupole sections. The floating DC voltage applied to the quadrupole sections is also the same (20 V) in the configuration shown in FIG. 5A and gradually (stepwise) changed from 20 to 0 V toward the ion guide exit in the configuration shown n FIG. 7A. To obtain a beam focused approximately at F=21 mm, the voltage on the central electrode of the Einzel lens was adjusted to 13.33 and 13.3 V in the configurations shown in FIGS. 5A–B and 7A–B, respectively. The simulated beam waist diameter $d_{waist}$ is shown to be 0.39 mm for the configuration shown n FIG. 5A (see FIG. 6 and its inset), and is shown to be 0.44 mm for the configuration shown n FIG. 7A–B (see FIG. 8 and its inset). These values as well as the ion beam divergence are about three times higher than those observed in the embodiments of the present invention shown in FIGS. 1A–B and FIG. 2.

Figure 9:
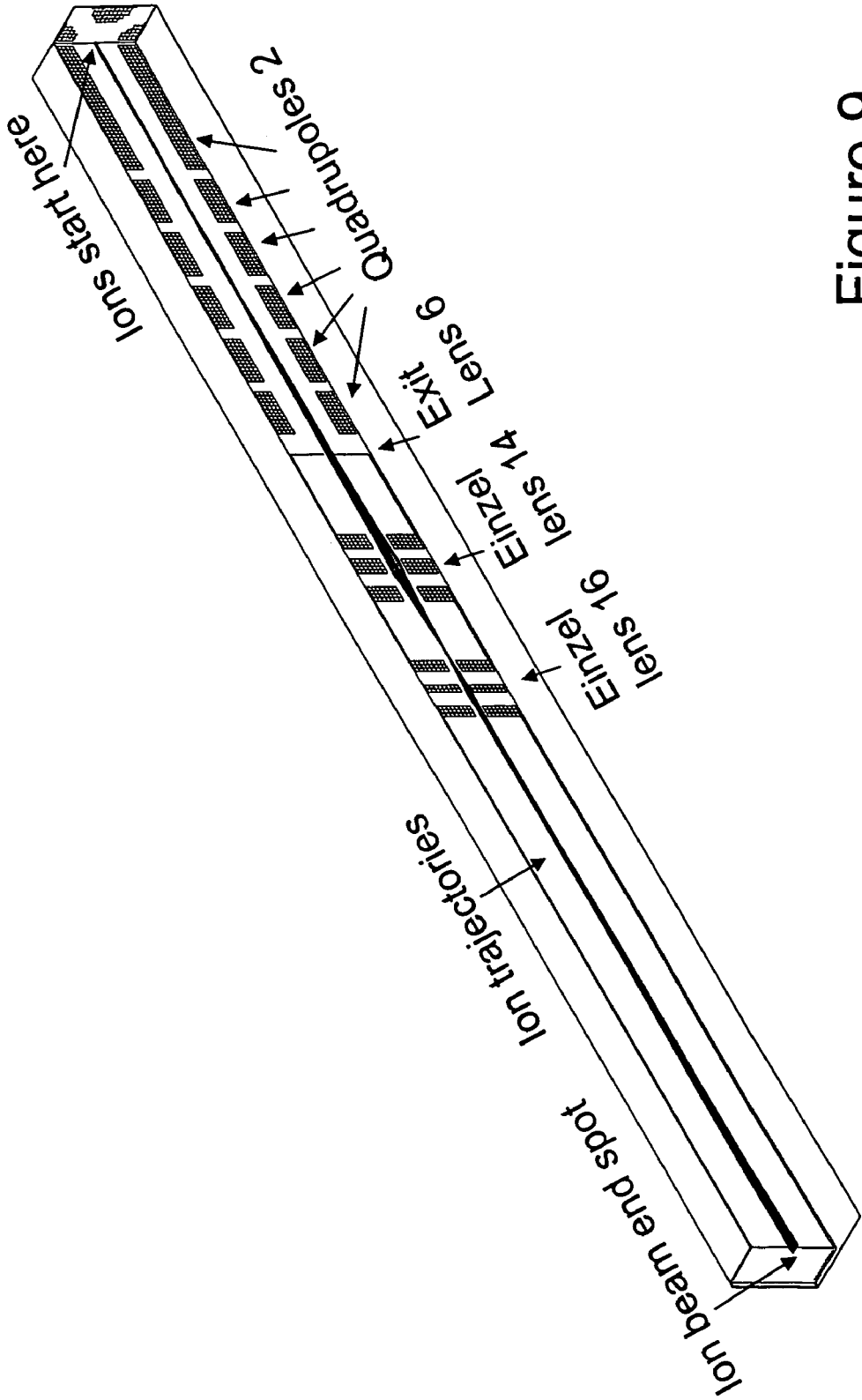
FIG. 9 is a schematic depicting another embodiment of the present invention including an ion guide combined with two Einzel lenses to obtain an ion beam suitable for utilizing in an oa-TOF mass spectrometer.

The ion beam divergence can be simply translated into an ion beam density and finally to the sensitivity of an oa-TOF instrument utilizing such beams in its design. For comparison purposes, a simulation comparison for the parallel ion beam formation required for oa-TOF-MS operation for the configurations shown in FIGS. 1A–B and FIGS. 5A–B was made. To obtain a "parallel" ion beam, one more Einzel lens 16 (such as for example having three cylindrical electrodes of 3 mm thick, each having 2-mm diameter axial holes and located at the distance of 2 mm from each other) as shown in FIG. 9. The center of the second Einzel lens 16 was placed in the simulation at a distance of 28 mm from that of the first Einzel lens 14. The focusing voltage on the central electrodes of the first Einzel lens was tuned to produce the least divergent beam, i.e., to get the minimum ion spot diameter at a distance of 56 mm from the center of the second lens, while the voltage on the central electrode of the second Einzel lens was set to 14.27 V, during the simulation. Note that, during the simulation, the side electrodes of both lenses were grounded. Note also that, under the focusing conditions chosen for the simulation, the ion beam after the second Einzel lens would be absolutely parallel if the ion beam divergence were equal to zero.

Figure 10:
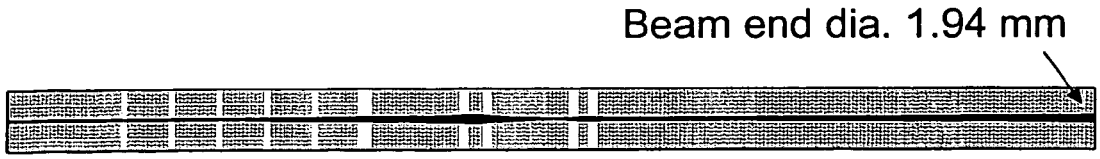
FIG. 10 presents the results of numerical simulation of ion beam trajectories for the ion guide configuration corresponding to the embodiment of the present invention shown in FIG. 9.
Figure 11:
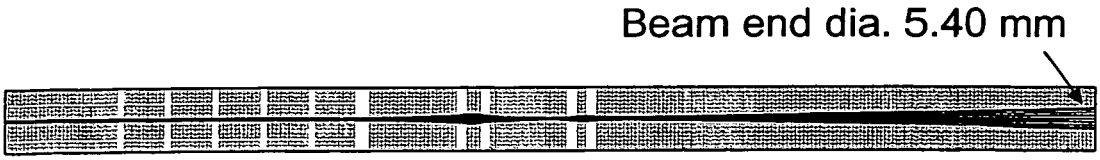
FIG. 11 presents the results of numerical simulation of ion beam trajectories for the ion guide configuration corresponding to the background art shown in FIG. 5.

The ion spot diameter obtained for the beam corresponding to the embodiment of the present invention shown in FIG. 1A is 1.94 mm (see FIG. 10, the voltage on the first Einzel lenses was 12.6 V) while that obtained for the background art configuration shown in FIG. 5A is 5.40 mm (see FIG. 11, the voltage on the first Einzel lens was 13.53 V). Such difference is in line with about a three times smaller divergence obtained for the embodiment of the present invention in FIG. 1A as compared to that obtained for the background art configuration shown in FIG. 5A. Since the ion beam density in the cylindrical symmetry is proportional to the square of the beam divergence, the ion beam density in FIG. 10 is about an order of the magnitude larger than that in FIG. 11. This means that after clipping the beam (by using restrictive apertures or slits—not shown in FIG. 11) to have the same spot size (that is required to get the same resolution in oa-TOF-MS) the sensitivity in the embodiments of the present invention shown in FIGS. 1A and 10 will be about an order of the magnitude larger than that for the background art configuration shown in FIGS. 5A and 11.

Similarly, if the beams are not clipped, then due to the larger divergence and spot size of the beam, the resolution in the background art configuration will be about an order of magnitude smaller than that for the embodiment of the present invention shown in FIGS. 1A and 10.

Figure 12:
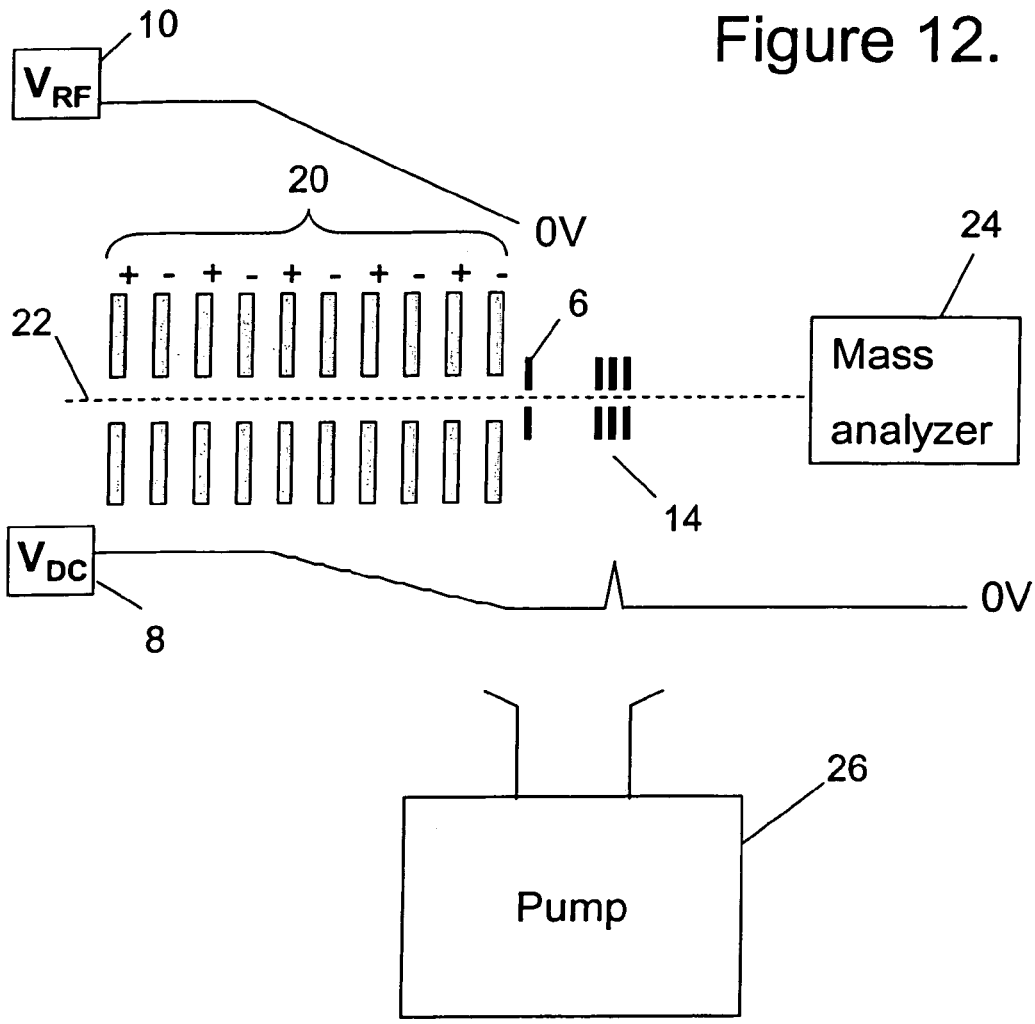
FIG. 12 is a schematic depicting another embodiment of the present invention including an ion guide having a set of segmented ring electrodes.

Implementation of the present invention is not limited by the embodiments illustratively shown above in FIGS. 1A and 3A. It is clear for those skilled in the art that the trapping field strength depends not only on the RF voltage amplitude $V_{RF}$ but, as it follows from the formula (2), also on the frequency Q of the trapping voltage and the ion guide effective diameter $d=2r_0$. Thus, the trapping field strength near the ion guide exit can be decreased by either decreasing the trapping voltage $V_{RF}$ or increasing the trapping field frequency Ω or the ion guide effective diameter d (by making end sections of the ion guide with larger diameter rods) In addition, the ion guide sections can be made of more that 4 rods, for example, of six (hexapoles), eight (octapoles) or more rods (multipoles). Moreover, as shown in FIG. 12, those sections can be made of stacked ring electrodes 20, instead of the parallel rods. The major dependencies of the trapping field inside of the stacked ring ion guide on the trapping voltage amplitude, frequency and the ion guide "effective" diameter remain the same as those for the quadrupole and multipole ion guides.

Accordingly, ions can be transmitted along the longitudinal axis 22 toward the ion exit 6 and then pass through the lens 14 to be focused and/or collimated. A mass analysis unit 24 such as an orthogonal extraction time-of-fight mass spectrometer, a quadrupole mass spectrometer, a quadrupole ion trap mass spectrometer, a Fourier transform ion cyclotron mass spectrometer, and a magnetic sector instrument can be utilized to analyze ion masses in the ion beam here (and in the other embodiments). A pump 26 (e.g., a differential pump) can be used here (and in the other embodiments) to reduce the pressure beyond the ion guide exit 6 or in the interior of the ion guide.

Figure 13:
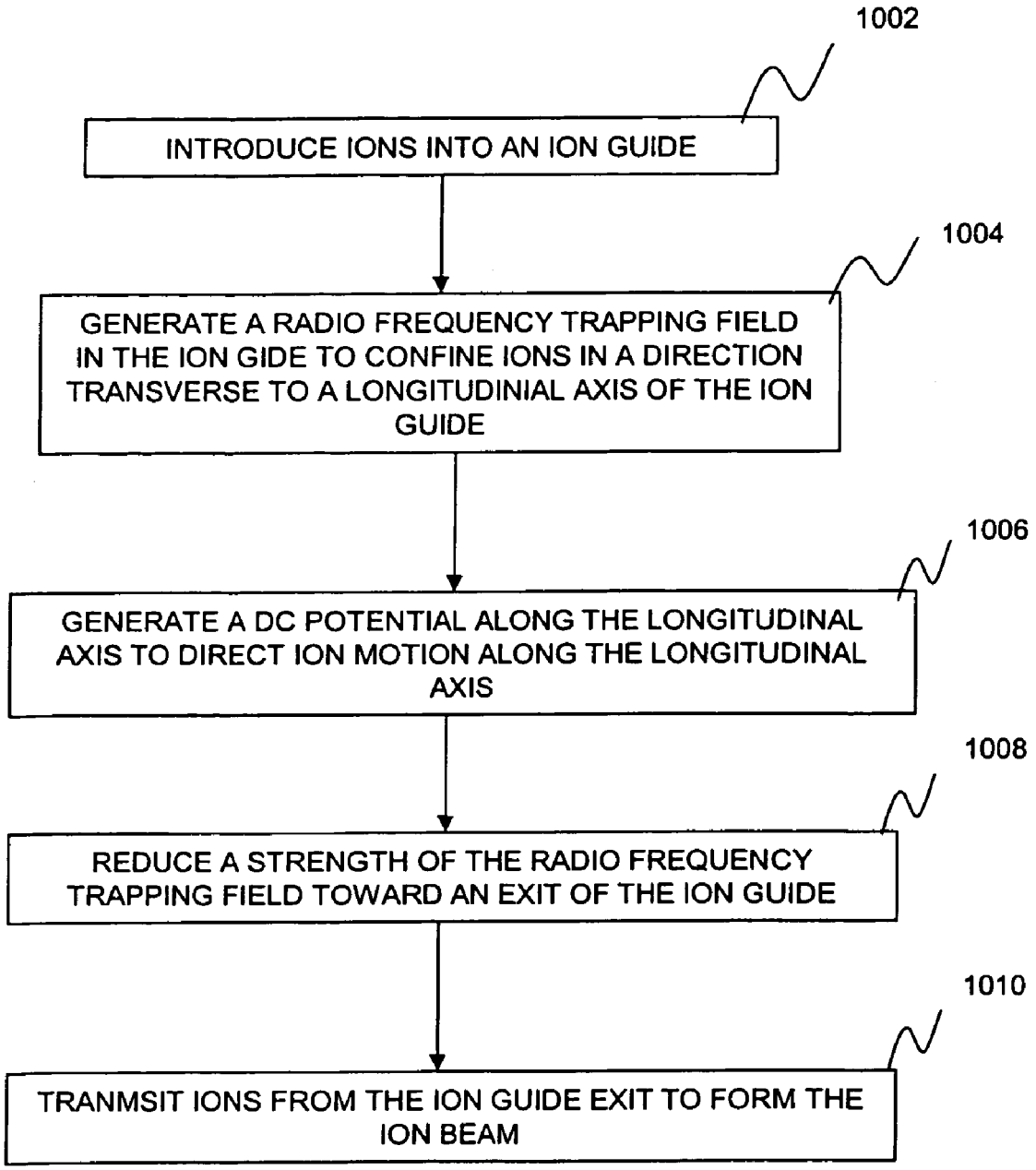
FIG. 13 depicts a flowchart illustrating a method according to the present invention.

In one embodiment of the present invention, there is provided a method for producing an ion beam from an ion guide, as shown illustratively in FIG. 13. At step 1002, ions are introduced into the ion guide. At step 1002, the ions can be generated for transmission into the ion guide, for example by utilizing at least one of electrospray ionization, chemical ionization, laser ionization, and matrix-assisted laser ionization to generate the ions. At step 1004, a radio frequency trapping field is generated in the ion guide to confine ions in a direction transverse to a longitudinal axis of the ion guide. At step 1006, a DC potential is generated along the longitudinal axis to direct ion motion along the longitudinal axis. At step 1008, a strength of the radio frequency trapping field toward an ion guide exit of the ion guide is reduced. At step 1010, the ions are transmitted from the ion guide exit to form the ion beam.

In step 1008, the strength of the radio frequency trapping field can be changed in a graduated or stepwise reduction toward the ion guide exit. Further, the strength of the radio frequency trapping field can be decreased to a value smaller than the trapping field on the initial multipole ion guide.

In step 1006, the applied DC potential can be adjusted (or set) to accelerate ions toward the ion guide exit. In one aspect of step 1006, the applied DC potential can be reduced in correlation with the strength of the radio frequency trapping field toward the ion guide exit. In another aspect of step 1006, the ions can be directed through a multipole guide having for example segmented sets of rod electrodes. The rods can form multipoles having at least one of four, six, and eight rods in each set. In another aspect of step 1006, the ions can be directed through a set of ring electrodes. Each ring electrode can have a through hole positioned along the longitudinal axis of the ion guide.

As such, the ions can be transmitted in a set of segmented electrodes. The amplitudes of the radio frequency trapping voltages can be reduced on the set of segmented electrodes such that an amplitude of a radio frequency trapping voltage on one of the segmented electrodes closest to the ion guide exit has an amplitude smaller than an amplitude at the entrance electrodes.

Additionally, in one aspect of step 1010, a trapping voltage frequency across the set of segmented rod electrodes can be increased such that one of the segmented electrodes closest to the ion guide exit has the highest frequency. For example, the trapping voltage frequency can be adjusted across the segmented ion guide from 0.5 MHz to 5 MHz.

Additionally, in another embodiment of step 1010, an effective ion guide diameter can be increased by increasing a rod diameter of rods in an ion guide, increasing a diameter of through holes in a set of ring electrodes of the ion guide, and/or increasing the distance between the ring electrodes.

Further, in another aspect of step 1010, ions in the ion guide can be collided with neutral molecules in the ion guide, such as for example by transmitting the ions in the ion guide under pressures greater than 1 mTorr. Alternatively, the ions in the ion guide can be moved along the longitudinal axis under near collisionless conditions, such as for example by moving the ions under pressures less than 1 mTorr. In another aspect of step 1010, the ions in the ion guide can be collided with neutral molecules in the ion guide at pressures greater than 1 mTorr, and subsequently extracted into a reduced-pressure region of less than 1 m Torr to form the ion beam. Such extraction can occur by extracting the ions from the ion guide exit region through an aperture configured to reduce a pressure between the ion guide exit region and the reduced-pressure region. The reduced-pressure region can be differentially pumped to a lower pressure than the ion guide. The collisions of the ions in the ion guide with the neutral molecules can fragment ions to produce fragmented ions in the ion beam.

After step 1010, at least one of an orthogonal extraction time-of-fight mass spectrometer, a quadrupole mass spectrometer, a quadrupole ion trap mass spectrometer, a Fourier transform ion cyclotron mass spectrometer, and a magnetic sector instrument can be utilized to analyze ion masses in said ion beam. After step 1010, at least one ion optical lens can be utilized to adjust an ion beam shape of the ion beam.

Numerous modifications and variations on the present invention are possible in light of the above teachings. It is, therefore, to be understood that within the scope of the accompanying claims, the invention may be practiced otherwise than as specifically described herein.

The invention claimed is:

1. A method for producing an ion beam from an ion guide, comprising:

introducing ions into the ion guide;

generating a radio frequency trapping field in the ion guide to confine ions in a direction transverse to a longitudinal axis of the ion guide;

generating a DC potential along the longitudinal axis to direct ion motion along the longitudinal axis;

reducing a strength of the radio frequency trapping field toward an ion guide exit of the ion guide; and transmitting the ions from the ion guide exit to form said ion beam.

2. The method of claim 1, wherein said reducing comprises:

changing the strength of the radio frequency trapping field in a graduated reduction toward the ion guide exit.

3. The method of claim 1, wherein said reducing comprises:

changing the strength of the radio frequency trapping field in a stepwise reduction toward the ion guide exit.

4. The method according to either one of claims 1, 2, or 3, wherein said reducing comprises:

decreasing the strength of the radio frequency trapping field to about zero at the ion guide exit.

5. The method according to claim 4, wherein the decreasing the strength to about zero comprises:

decreasing the strength by more than 10 times as compared to a strength of the radio frequency trapping field at an entrance to the ion guide.

6. The method according to either one of claims 1, 2, or 3, further comprising:

adjusting said DC potential to accelerate ions toward the ion guide exit.

7. The method of claim 6, wherein said adjusting comprises:

reducing said DC potential in correlation with the strength of the radio frequency trapping field toward the ion guide exit.

8. The method of claim 6, further comprising:

moving ions along the longitudinal axis under near collisionless conditions.

9. The method of claim 8, wherein said moving comprises:

moving said ions under pressures less than 1 mTorr.

10. The method according to either one of claims 1, 2, or 3, further comprising:

utilizing as said ion guide a multipole guide.

11. The method of claim 10, wherein said utilizing comprises:

transmitting said ion beam through segmented sets of rod electrodes.

12. The method of claim 11, wherein said transmitting comprises:

transmitting said ion beam through at least one of four, six, and eight rods in each set.

13. The method according to either one of claims 1, 2, or 3, further comprising:

utilizing as said ion guide a set of ring electrodes, each ring electrode having a through hole positioned along the longitudinal axis of the ion guide.

14. The method according to either one of claims 1, 2, or 3, further comprising:

transmitting said ions in a set of segmented electrodes.

15. The method of claim 14, wherein said reducing comprises:

reducing amplitudes of the radio frequency trapping voltages on said set of segmented electrodes such that an amplitude of a radio frequency trapping voltage on one of said segmented electrodes closest to the ion guide exit has an amplitude of about zero.

16. The method according to claim 14, further comprising:

increasing a trapping voltage frequency across said set of segmented rod electrodes such that one of said segmented electrodes closest to the ion guide exit has the highest frequency.

17. The method according to claim 16, wherein the increasing comprises:

changing said trapping voltage frequency from 0.5 to 5 MHz.

18. The method according to claim 1, 2, or 3, wherein said reducing comprises:

increasing an effective ion guide diameter by at least one of increasing a rod and inscribed diameter of rods in the ion guide, increasing a through hole diameter in a set of ring electrodes of the ion guide, and increasing a separation distance between the ring electrodes.

19. The method of claim 1, further comprising:

colliding said ions with neutral molecules in the ion guide.

20. The method of claim 19, wherein said colliding comprises:

transmitting said ions in the ion guide under pressures greater than 1 mTorr.

21. The method according to either one of claims 1, 2, or 3, further comprising:

colliding said ions with neutral molecules in the ion guide at pressures greater than 1 mTorr; and extracting said ions from an ion guide exit region into a reduced-pressure region of less than 1 m Torr to form the ion beam.

22. The method of claim 21, further comprising:

extracting said ions from the ion guide exit region through an aperture configured to reduce a pressure between the ion guide exit region and the reduced-pressure region.

23. The method of claim 22, further comprising:

differential pumping of said ion guide exit region to a lower pressure than a pressure in the ion guide.

24. The method of claim 1, further comprising:

fragmenting said ions by collisions with neutral molecules in the ion guide to produce fragmented ions in said ion beam.

25. The method according to claim 6, further comprising:

differential pumping of an ion acceleration region in the ion guide.

26. The method of 25, wherein said differential pumping comprises:

pumping to obtain an ion collisionless mode in the ion acceleration region.

27. The method according to claim 7, further comprising:

differential pumping of an ion acceleration region in the ion guide.

28. The method of 27, wherein said differential pumping comprises:

pumping to obtain an ion collisionless mode in the ion acceleration region.

29. The method of claim 1, further comprising:

using at least one of an orthogonal extraction time-of-fight mass spectrometer, a quadrupole mass spectrometer, a quadrupole ion trap mass spectrometer, a Fourier transform mass spectrometer, and a magnetic sector instrument to analyze ion masses in said ion beam.

30. The method of claim 1, further comprising:

utilizing at least one ion optical lens to adjust an ion beam shape after said transmitting of the ions from said ion guide.

31. The method of claim 1, wherein the introducing comprises:

generating ions for transmission into the ion guide.

32. The method of claim 31, wherein the generating comprises:

utilizing at least one of electrospray ionization, chemical ionization, laser ionization, and matrix-assisted laser ionization to generate the ions.

33. A system for producing an ion beam, comprising:

an ion guide configured to transmit ions along a longitudinal axis of the ion guide and configured to trap ions in a direction transverse to the longitudinal axis via a radio frequency trapping field;

said ion guide including a segmented set of electrodes spaced along the longitudinal axis and an ion guide exit at the last of the segmented set of electrodes; and a radio frequency device configured to supply the radio frequency trapping field such that a strength of the radio frequency trapping field is reduced toward the ion guide exit.

34. The system of claim 33, wherein said radio frequency device is configured to change the strength of the radio frequency trapping field in a graduated reduction toward the ion guide exit.

35. The system of claim 33, wherein said radio frequency device is configured to change the strength of the radio frequency trapping field in a stepwise reduction toward the ion guide exit.

36. The system of claim 33, further comprising:

a DC power supply configured to provide a DC potential to accelerate ions toward the ion guide exit.

37. The system of claim 36, further comprising:

a pump configured to differentially pump a region of ion acceleration from the ion guide.

38. The system of 37, wherein said differential pump is configured to pump said region of acceleration to obtain an ion collisionless mode.

39. The system of claim 36, wherein said DC power supply is configured to provide said DC potential in correlation with the strength of the radio frequency trapping field near the ion guide exit.

40. The system of claim 39, further comprising:

a pump configured to differentially pump a region of ion acceleration from the ion guide.

41. The system of 40, wherein said differential pump is configured to pump said region of acceleration to obtain an ion collisionless mode.

42. The system of claim 33, wherein said ion guide comprises a multipole guide.

43. The system of claim 42, wherein said multipole guide comprises a set of rod electrodes having at least one of four, six, and eight rods in each set.

44. The system of claim 33, wherein said ion guide comprises a set of ring electrodes, each ring electrode having a through hole positioned along the longitudinal axis of the ion guide.

45. The system of claim 33, further comprising:

a pump configured to differentially pump a region of the ion guide exit.

46. The system of 45, wherein said differential pump is configured to pump said region to obtain an ion collisionless mode.

47. The system of claim 33, further comprising:

at least one of an orthogonal extraction time-of-fight mass spectrometer, a quadrupole mass spectrometer, a quadrupole ion trap mass spectrometer, a Fourier transform mass spectrometer, and a magnetic sector instrument configured to analyze ion masses in said ion beam.

48. The system of claim 33, further comprising:

at least one ion optical lens configured to adjust an ion beam shape of the ion beam after transmitting the ions from the ion guide exit.

49. The system of claims 47, wherein the at least one ion optical lens comprises an Einzel lens.

* * * * *